US005957446A

United States Patent [19]

Takanuma

[11] Patent Number: 5,957,446

[45] Date of Patent: Sep. 28, 1999

[54] SHEET FEEDING APPARATUS HAVING A MANUAL SHEET FEEDING ENTRANCE

[75] Inventor: Kouji Takanuma, Chiba, Japan

[73] Assignee: Ricoh Company, Ltd., Tokyo, Japan

[21] Appl. No.: 08/878,952

[22] Filed: Jun. 19, 1997

[30] Foreign Application Priority Data

| | | | |
|---|---|---|---|
| Jun. 19, 1996 | [JP] | Japan | 8-157793 |
| Jul. 12, 1996 | [JP] | Japan | 8-182922 |
| May 30, 1997 | [JP] | Japan | 9-141251 |

[51] Int. Cl.[6] ..... B65H 3/44

[52] U.S. Cl. ..... 271/9.09; 271/9.11; 271/9.13

[58] Field of Search ..... 271/9.09, 9.11, 271/9.13, 242, 258.01

[56] References Cited

U.S. PATENT DOCUMENTS

| | | | |
|---|---|---|---|
| 5,308,054 | 5/1994 | Sugito | 271/9.09 |
| 5,415,387 | 5/1995 | Suzuki | 271/242 X |
| 5,529,298 | 6/1996 | Gough et al. | 271/9.09 |

FOREIGN PATENT DOCUMENTS

| | | | |
|---|---|---|---|
| 63-230435 | 9/1988 | Japan | 271/9.09 |
| 5309887 | 11/1993 | Japan . | |

*Primary Examiner*—David H. Bollinger

*Attorney, Agent, or Firm*—Cooper & Dunham LLP

[57] ABSTRACT

A sheet feeding apparatus includes a main body power source for selectively supplying power to sections of the apparatus and a sheet containing section for containing a plurality of sheets, and a manual sheet feeding entrance for feeding a sheet by manual operation. A sheet conveying path is provided in which the sheet containing section and the manual sheet feeding entrance are selectively used as a selective start position for feeding a sheet to the conveying path. A registration mechanism temporarily stops the sheet which is fed to the sheet conveying path and a registration sensor detects the sheet which is fed towards the registration mechanism, the registration sensor being disposed at a position wherein a sheet which is inserted into the manual sheet feeding entrance and a sheet conveyed from the sheet containing section are detected. A sheet feeding controller operates the registration mechanism after a predetermined time period has passed from a time when the sheet is detected by the registration sensor if the sheet is fed from the sheet containing section, and operates the registration mechanism after a predetermined time period has passed from a time when the sheet is detected by the registration sensor if the sheet is fed from the manual sheet feeding entrance after being inserted and detected by the registration sensor. A sheet jam judging unit judges an occurrence of a sheet jam if the sheet is detected by the registration sensor at an undesirable time other than at a time when the main body power source is turned on.

18 Claims, 6 Drawing Sheets

SHEET FEEDING APPARATUS HAVING A MANUAL SHEET FEEDING ENTRANCE

BACKGROUND OF THE INVENTION

1. Field of the Invention

The present invention relates to a sheet feeding apparatus for feeding a sheet into an image forming apparatus.

2. Discussion of the Background

In recent years, image forming apparatuses have generally been provided with a sheet feeding apparatus which individually feeds a sheet to be copied (hereinafter called a sheet) or the like, which is contained in a sheet feeding cassette. Various kinds of sheet feeding devices can be utilized. For example, a sheet feeding device having a manual sheet feeding entrance can be provided in addition to a sheet containing section such as a sheet feeding cassette or the like for selective use as a starting position of a sheet feeding operation.

In such a sheet feeding apparatus, a sheet containing section and the manual sheet feeding entrance are communicated with one sheet conveying path, and one of the sheet containing section and the manual sheet feeding entrance is selected as a starting position of the sheet feeding operation. There are typically two devices provided at the sheet conveying path. One device is a registration mechanism which temporarily stops the sheet which is individually being fed from the sheet containing section or the manual sheet feeding entrance. A second device is a registration sensor which detects the position of the sheet as it is fed from the sheet containing section or the manual sheet feeding entrance to the registration mechanism.

In such a sheet feeding apparatus, for example, in a case of individually feeding the sheet from the sheet containing section to an image forming section, the sheet is temporarily stopped by the registration mechanism to adjust the timing for when the sheet is to be conveyed into the image forming section. Presently, this is performed by detecting a position of the sheet with the registration sensor as the sheet is fed towards the registration mechanism. The sheet is held by the registration mechanism, temporarily stopping motion of the sheet until after a predetermined time period has passed from the detected time point. The sheet is then fed towards the image forming section at an appropriate timing.

In a case of feeding the sheet from the manual sheet feeding entrance, when an operator inserts a sheet to the manual sheet feeding entrance, the sheet is started to be fed after being detected by a special sensor. In a manner as stated above, the sheet is also detected by the registration sensor and temporarily stopped by the registration mechanism. The sheet is then fed towards the image forming section. The sheet feeding timing is thus adjusted by the temporary stop.

Further, since the registration sensor detects the position of the sheet as it is fed towards the registration mechanism in the aforementioned manner, an occurrence of a sheet jam can be judged by a jam detecting circuit if the registration sensor detects the position of the sheet at an undesirable time. For example, when the registration sensor continuously detects the position of the sheet after a predetermined time period has passed from a time in which the registration mechanism has ended the temporary stopping of the sheet, it is assumed that a sheet jam has occurred at a position of the registration sensor, and accordingly, the jam detecting circuit executes lighting of a jam lamp or sounding of a buzzer for reporting the occurrence of the sheet jam to the user.

In the aforementioned sheet feeding apparatus, a sheet can be fed from either one of the sheet containing section and the manual sheet feeding entrance. However, as mentioned above, a special detecting sensor is required for detecting the position of the sheet inserted into the manual sheet feeding entrance. There is also presently in use a sheet feeding apparatus having a registration sensor located at a position where the sheet is inserted into the manual sheet feeding entrance so that the manually inserted sheet can be detected without the need for a special sheet detecting sensor.

This type of sheet feeding apparatus requires no special sheet position detecting sensor at the position of the manual sheet feeding entrance. This is because the position of the sheet inserted into the manual sheet feeding entrance is detected by the registration sensor.

However, in this kind of sheet feeding apparatus, the jam detecting circuit judges that a sheet jam has occurred when a power switch is turned on in a state when a sheet remains in the manual sheet feeding entrance, because the position of the sheet is detected at an undesirable time by the registration sensor. Therefore, the operator is required to perform unnecessary operations for removing a jammed sheet, in spite of the fact that no actual sheet jam has occurred.

The case where the sheet feeding apparatus is powered up in a state in which an inserted sheet is present in the manual sheet feeding entrance can easily and frequently occur. For example, when a power switch of the image forming apparatus is turned off when a sheet has been inserted into the manual sheet feeding entrance, and later, the power switch is turned, while the sheet remains in the manual sheet feeding entrance, a false sheet jam judgment will be made. This situation can occur in daily use of the image forming apparatus and can cause the above-mentioned problems. In other words, the operator may typically turn off the power switch of the image forming apparatus during the night time or the like when the image forming apparatus is not being used, without removing the manually fed sheet from the manual sheet feeding entrance. In addition, for safety reasons the image forming apparatus is typically set so that the power is automatically turned off when the operator opens the main body or a sheet conveying path, for example, for removing a jammed sheet. Therefore, after removing a jammed sheet, even though the power is automatically turned on by returning the main body or the sheet conveying path to the closed state, if the sheet inserted into the manual sheet feeding entrance remains, there occurs a situation in which the sheet feeding apparatus is started while the sheet inserted into the manual sheet feeding entrance remains, thus causing the above-noted erroneous jam detection problems.

SUMMARY OF THE INVENTION

The present invention has been made in consideration of such problems, and accordingly it is an object of the present invention to provide a sheet feeding apparatus having a manual sheet feeding entrance without the need for providing a special sheet detecting sensor for detecting an inserted sheet. This reduces the manufacturing cost and simplifies construction of the device. According to an aspect of the present invention a sheet feeding apparatus includes a main body power source for selectively supplying power to sections of the apparatus and a sheet containing section for containing a plurality of sheets, and a manual sheet feeding entrance for feeding a sheet by manual operation.

A sheet conveying path is provided in which the sheet containing section and the manual sheet feeding entrance are selectively used as a selective start position for feeding a sheet to the conveying path.

A registration mechanism temporarily stops the sheet which is fed to the sheet conveying path and a registration sensor detects the sheet which is fed towards the registration mechanism, the registration sensor being disposed at a position wherein a sheet which is inserted into the manual sheet feeding entrance and a sheet conveyed from the sheet containing section are detected.

A sheet feeding controller operates the registration mechanism after a predetermined time period has passed from a time when the sheet is detected by the registration sensor if the sheet is fed from the sheet containing section, and operates the registration mechanism after a predetermined time period has passed from a time when the sheet is detected by the registration sensor if the sheet is fed from the manual sheet feeding entrance after being inserted and detected by the registration sensor.

A sheet jam judging unit judges an occurrence of a sheet jam if the sheet is detected by the registration sensor at an undesirable time other than at a time when the main body power source is turned on.

The sheet feeding apparatus described above, may further include a mode selector for selecting whether to judge an occurrence of a sheet jam by the sheet jam judging unit when detecting the sheet by the registration sensor at a moment when the power is turned on.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
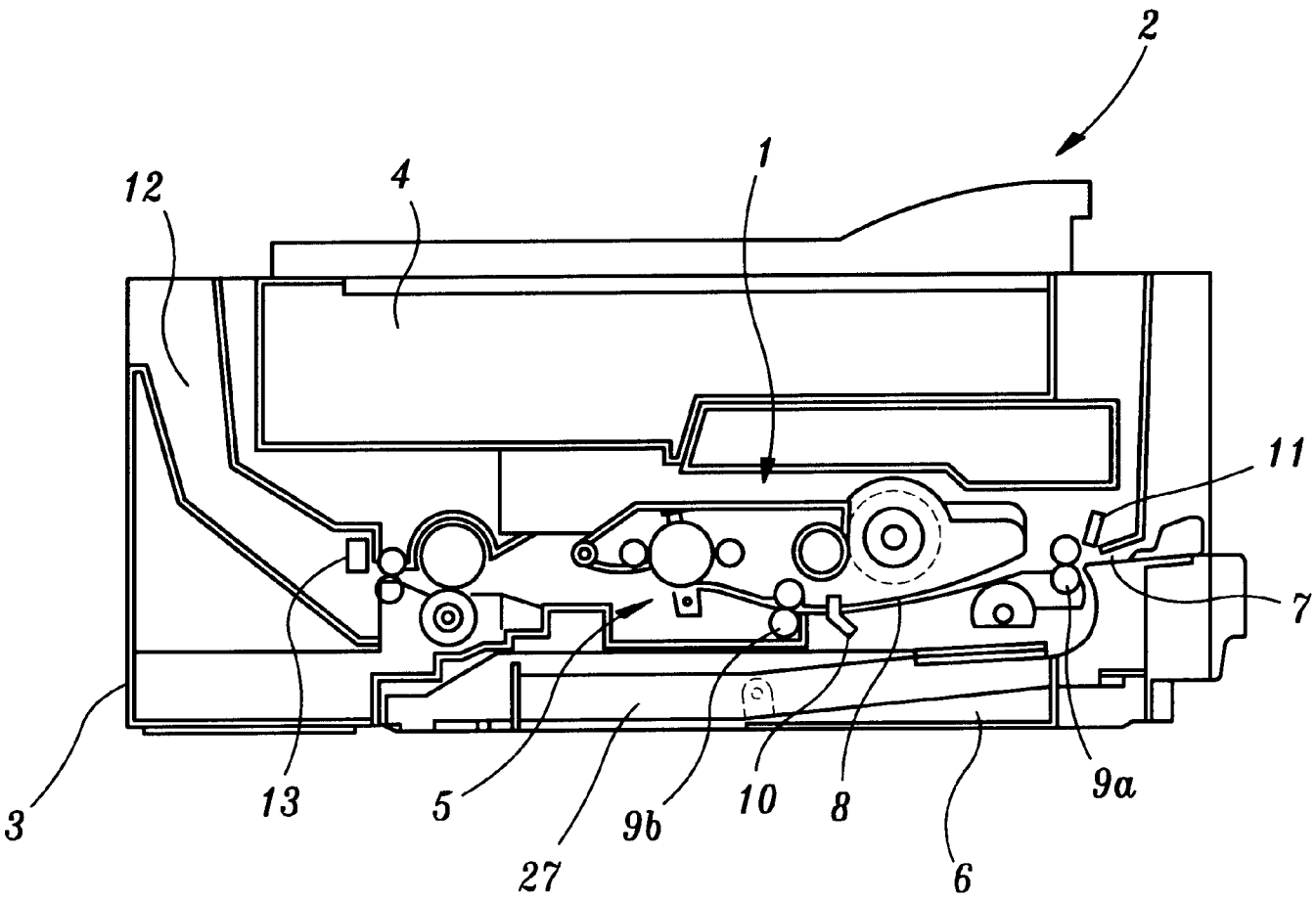
FIG. 1 is a longitudinal side view showing an internal structure of a digital copying machine including a sheet feeding apparatus according to an embodiment of the present invention.

An embodiment of the present invention is explained hereinafter referring to FIGS. 1 to 3. For purposes of simplifying the description, front, back, right, and left directions referred to hereinbelow are based on the left side of FIG. 1 as being the front direction. This definition is for convenience of simplifying the explanation only and is not intended to limit the direction of any actual installation and use of the sheet feeding apparatus.

A sheet feeding apparatus 1 according to an embodiment of the present invention is formed as a part of a digital copying machine 2 as an image forming apparatus. At an upper part of the main body 3 of the digital copying machine 2, an image reading section 4 which is composed of an image scanner (not shown) is assembled and an electrophotographic image forming section 5 is disposed at an approximately center part of the main body 3. Beneath the main body 3, sheet feeding cassette 6, as a sheet containing section is disposed, and a manual sheet feeding entrance 7 is formed at the backside of the main body 3.

The sheet feeding cassette 6 and the manual sheet feeding entrance 7 communicate with a sheet conveying path 8 as a starting position for sheet feeding. The sheet conveying path 8 communicates with the image forming section 5. Conveying rollers 9 are disposed at a plurality of positions. For example, conveying rollers 9*a* are positioned after the manual sheet feeding entrance 7 and rollers 9*b* are positioned before the image forming section 5 in the sheet feeding direction. A registration mechanism 10 including a solenoid is provided just before conveying rollers 9*b*. A registration sensor 11 which is composed of a photo sensor is provided just before conveying rollers 9*a*. The sheet conveying path 8 communicates with a sheet discharging section 12 through the image forming section 5. At the sheet discharging section 12, a sheet discharging sensor 13 is mounted.

Figure 2:
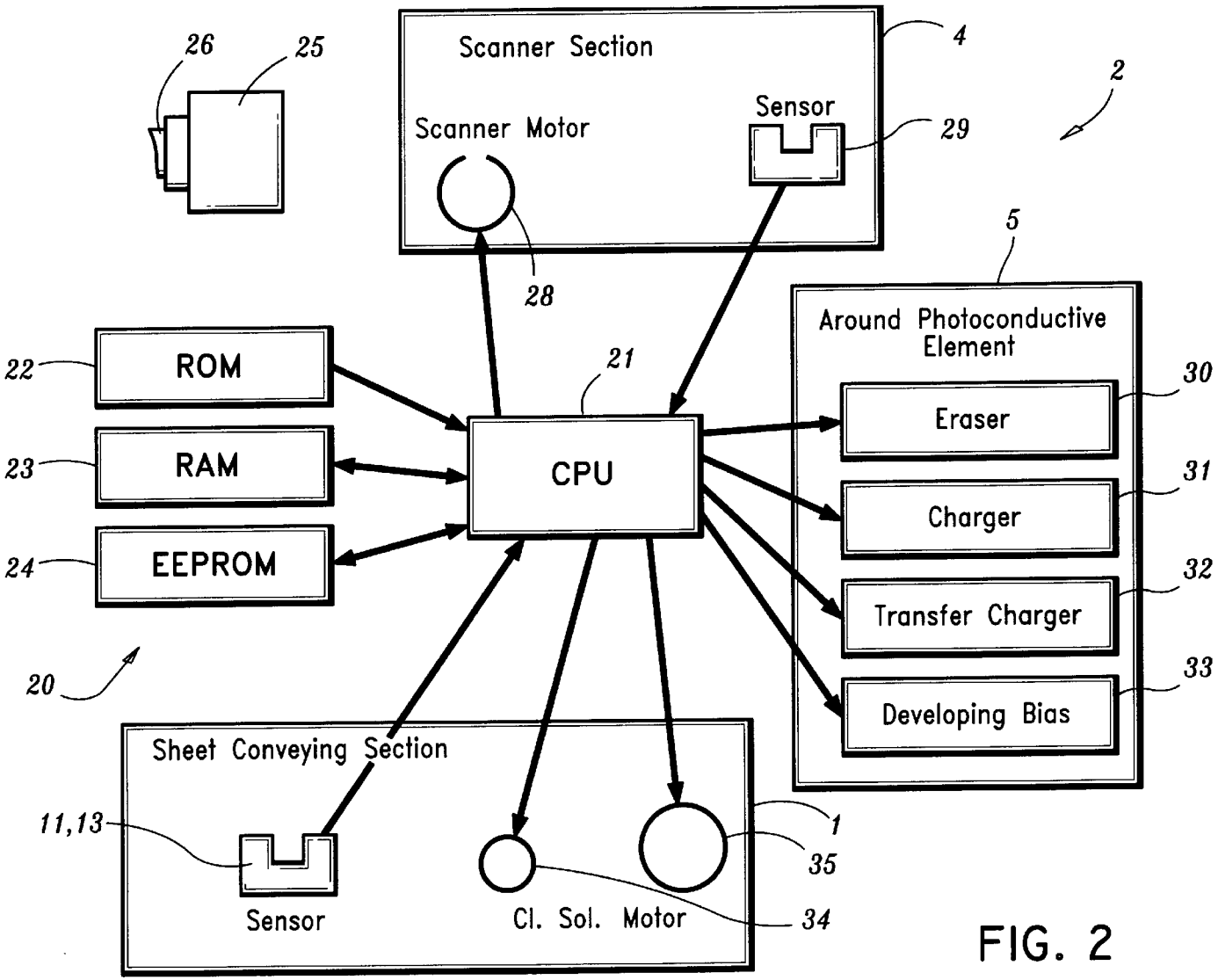
FIG. 2 is a block diagram showing a circuit structure of the digital copying machine.
Figure 3:
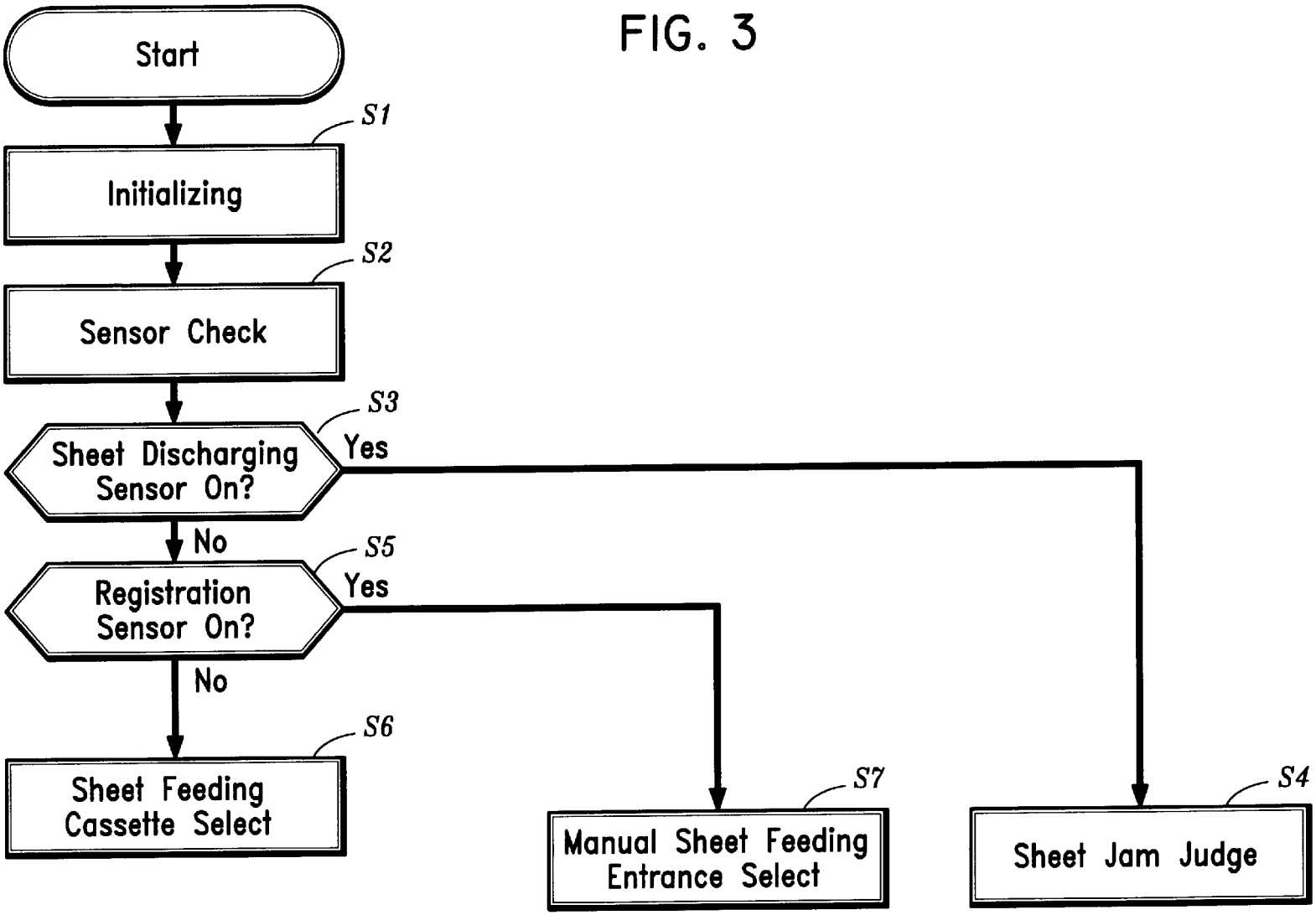
FIG. 3 is a flowchart showing a processing operation at a power-on timing of the sheet feeding apparatus.

The digital copying machine 2 is provided with a micro computer 20, and the micro computer 20 includes a CPU (Central Processing Unit) 21, ROM (Read Only Memory) 22, RAM (Random Access Memory) 23, EEPROM (Electrically Erasable Programable ROM) 24 as a state memory device and the like as shown in FIG. 2. The image reading section 4, the image forming section 5, the sheet feeding apparatus 1, and the like are connected, and operations of each of these elements are controlled by the CPU 21. As shown, scanner section 4 can include a scanner motor 28 and a sensor 29 for sensing a sheet to be scanned, for example. Image forming section 5 can include an eraser 30, a charger 32 and a bias developing unit 33 just to name a few elements. These elements are all well known in the art and are not critical to an understanding of the present invention and therefore will not be described in detail. Sheet conveying section includes sensors 11 and 13, solenoid 34 and motor 35, for example. Further, a main body power source 25 for supplying power to each of the elements is provided, and an on/off switch 26 is connected to the main body power source 25. In accordance with the selective operation of on/off switch 26, the power supplied to each of the elements from the main body power source 25 is turned on or off. Further, the sheet conveying path 8 of the digital copying machine 2 is able to be opened, for example, for jammed sheet removal, and in such a case, when switch 26 is in the on position, the power supply from the main body power source 25 to each of the elements is automatically cut off.

An operation program of the CPU 21 is stored in the ROM 22, and the CPU 21 controls each of the elements by executing various kinds of data processing operations according to the operation program. The sheet feeding apparatus 1 of the present embodiment functions as a feeding control device, a sheet jamming judging device, and a feeding selection device.

The feeding control device function controls the feeding of sheets from the sheet feeding cassette 6 or the manual sheet feeding entrance 7, by controlling the motion of the conveying rollers 9 and the registration mechanism 10. For example, in a case of feeding a sheet 27 by a feed mechanism (not shown) from the sheet feeding cassette 6, a sheet is fed to the conveying rollers 9*a*. The sheet 27 is temporarily stopped by the registration mechanism 10 and the temporarily stopped sheet is released when a predetermined time period has passed after the sheet was detected by the registration sensor 11.

Further, when a sheet 27 fed from the manual sheet feeding entrance 7 is detected by the registration sensor 11, the conveying roller 9*a* is driven for a short period of time to support the leading edge of the sheet 27. When a sheet feeding instruction is inputted by an operator, the sheet 27 is started to be fed by continuously driving the conveying rollers 9*a*. In a manner as stated above, the sheet 27 is then temporarily stopped by the registration mechanism 10. This stopping action is released when a predetermined time period has passed after starting the sheet feeding operation.

The program which is necessary for the operation of the present invention is stored in the ROM 22, and according to the program, the CPU 21 controls the operation of the conveying rollers 9, and the registration mechanism 10.

A sheet jam judging device function detects a sheet jam via the micro computer 20 when the registration sensor 11 or the sheet discharging sensor 13 detects the existence of a sheet 27 at an undesirable time. For example, when the feeding of the sheet 27 is restarted after it was stopped by the registration mechanism 10 as described above, and the registration sensor 11 continues to detect the sheet 27 even though a predetermined time period has passed after releasing the temporary stopping of the sheet 27, the sheet jamming judging device judges that a sheet jam has occurred because the registration sensor 11 has detected the sheet 27 at an undesirable time. The sheet jam judging device judges when a sheet 27 is detected by the sheet discharging sensor 13 when the main body power source 25 is turned on. However, according to the present invention, if the registration sensor 11 detects a sheet 27 when the main body power source 25 is turned on, the sheet jam detecting device does not judge this as a sheet jam.

According to the present invention, the feeding selection device selects the sheet feeding cassette 6 if the registration sensor 11 does not detect the sheet 27 when the main body power source 25 is turned on. On the other hand, if the registration sensor 11 detects the sheet 27 when the power is turned on, the feeding selection device selects manual sheet feeding entrance 7 as a start position of sheet feeding.

In this construction, the sheet feeding apparatus 1 of the present embodiment is able to feed the sheet 27 from both the sheet feeding cassette 6 and the manual sheet feeding entrance 7. In a case of feeding the sheet 27 from the sheet feeding cassette 6, the sheet 27 is conveyed through the sheet conveying path 8 by the conveying rollers 9, and temporarily stopped by the registration mechanism 10 after detection by the registration sensor 11. As the registration mechanism 10 releases the temporary stopping of the sheet 27 after a predetermined time period has passed from the detecting operation by the registration sensor 11, the sheet 27 is fed towards the image forming section 5 in an appropriate timing. Further, in a case of feeding the sheet 27 from the manual sheet feeding entrance 7, when the sheet 27 is inserted into the manual sheet feeding entrance 7, the sheet 27 is detected by the registration sensor 11. Then, as the conveying rollers 9 are slightly rotated and the leading edge of the sheet 27 is supported (nipped), if a feeding instruction is inputted from a control panel (not shown) by a user, for example, the sheet feeding operation by the conveying rollers 9 is started. The manually fed sheet 27 is conveyed through the sheet conveying path 8 and temporarily stopped by the registration mechanism 10. As the sheet 27 is released from the temporary stopping by the registration mechanism after the predetermined time period has passed from starting of the feeding operation of the sheet 27, the sheet 27 is fed towards the image forming section 5 in an appropriate timing.

In the manner as stated above, if the sheet 27 is fed from the sheet feeding cassette 6 or the manual sheet feeding entrance 7 to the image forming section 5, the image forming section 5 forms a read/scanned image from the read original document (not shown) by the image reading section 4 onto the sheet 27. After such operation, the sheet 27 onto which the image is formed is discharged onto the sheet discharging section 12, and is detected by the sheet discharging sensor 13.

Furthermore, in a case in which the sheet discharging sensor 13 or the registration sensor 11 detects the sheet 27 at an undesirable time, the micro computer 20 judges an occurrence of the sheet jam, and automatically stops the motion of each of the sections and reports the occurrence of the sheet jam to the operator. For example, if the sheet 27 is detected by the registration sensor 11 or the sheet discharging sensor 13 even though the sheet 27 has not yet been started to be fed, the occurrence of a sheet jam is judged. In the same manner as mentioned above, in a case when the registration sensor 11 continuously detects the sheet 27 even though a predetermined time period has passed from restarting the sheet feeding of the registration mechanism 10, or in a case when the sheet 27 is not detected by the sheet discharging sensor 13 even though the predetermined time period has passed after finishing the operations which are performed by the image forming section 5, the occurrence of a sheet jam is judged.

FIGS. 3 to 6 are flowcharts showing processing operations at a power-on timing of the sheet feeding apparatus. The processing operation of the sheet feeding apparatus 1 is explained referring to FIG. 3.

The CPU is reset (initialized) in step S1 when the main body power source 25 is turned on by a manual operation of the on/off switch 26. The states of the sheet discharging sensor 13 and the registration sensor 11 are checked in step S2. For purpose of description, a sensor is said to be turned on when a sheet is being detected. The CPU determines whether or not the sheet discharging sensor 13 is turned on in step S3. If the answer is YES in step S3, the CPU judges that a sheet jam has occurred in step S4 because the sheet discharging sensor 13 has detected the sheet 27 even though a sheet has not yet been fed towards the sheet discharging sensor. If the answer is NO in step S3, the CPU determines whether or not the registration sensor 11 is turned on in step S5. Generally, when a sheet 27 is detected by the registration sensor 11 at the moment the main body power source 25 is turned on, this is a factor to be judged as an occurrence of the sheet jam. However, as mentioned above, according to the present invention, when the answer is YES in step S5, the CPU does not judge that a sheet jam has occurred because in the sheet feeding apparatus 1 in this embodiment, the CPU simply judges that a sheet 27 has been inserted into the manual sheet feeding entrance 7 and selects the manual sheet feeding entrance accordingly. The CPU thus selects the manual sheet feeding entrance 7 in step S7 as a starting position of sheet feeding when the registration sensor detects the sheet 27 at a moment when the power source is turned on.

The CPU selects the sheet feeding cassette 6 in step S6, as a starting position of sheet feeding when the registration sensor 11 does not detect the sheet 27 at a moment when the power source is turned on (NO in step S5). Therefore, when the main body power source 25 is turned on when a sheet 27 has been inserted into the manual sheet feeding entrance 7 by an operator who desires manual sheet feeding, the CPU 21 does not mis-judge the occurrence of a sheet jam.

Further, for example, when a jammed sheet removing operation is performed while a sheet 27 is kept inserted in the manual sheet feeding entrance 7, the CPU 27 will not mis-judge a sheet jam. That is, when the jammed sheet removing operation is performed while a sheet 27 is kept at the manual sheet feeding entrance 7, the power supply from the main body power source 25 to each of the sections of the apparatus is cut off by opening the sheet conveying path 8. The power source is turned on again returning the power supply to each of the sections by returning the sheet conveying path 8 to its initial state after the jammed sheets are removed. In this case, if the sheet 27 is kept in the manual sheet feeding entrance 7, the registration sensor 11 is judged to be turned on. In this manner, the manual sheet feeding entrance 7 is selected as the start position for sheet feeding in step S7, and is not mis-judged to be an occurrence of a sheet jam.

Accordingly, if the sheet 27 is inserted into the manual sheet feeding entrance 7 at a moment when the power source is turned on, the manual sheet feeding entrance 7 is automatically selected as a start position of sheet feeding, and if the sheet 27 is not inserted into the manual sheet feeding entrance 7, the sheet feeding cassette is automatically selected to be a start position of sheet feeding. Therefore, the start position of sheet feeding can be appropriately set without an intervening operation required by an operator.

Figure 4:
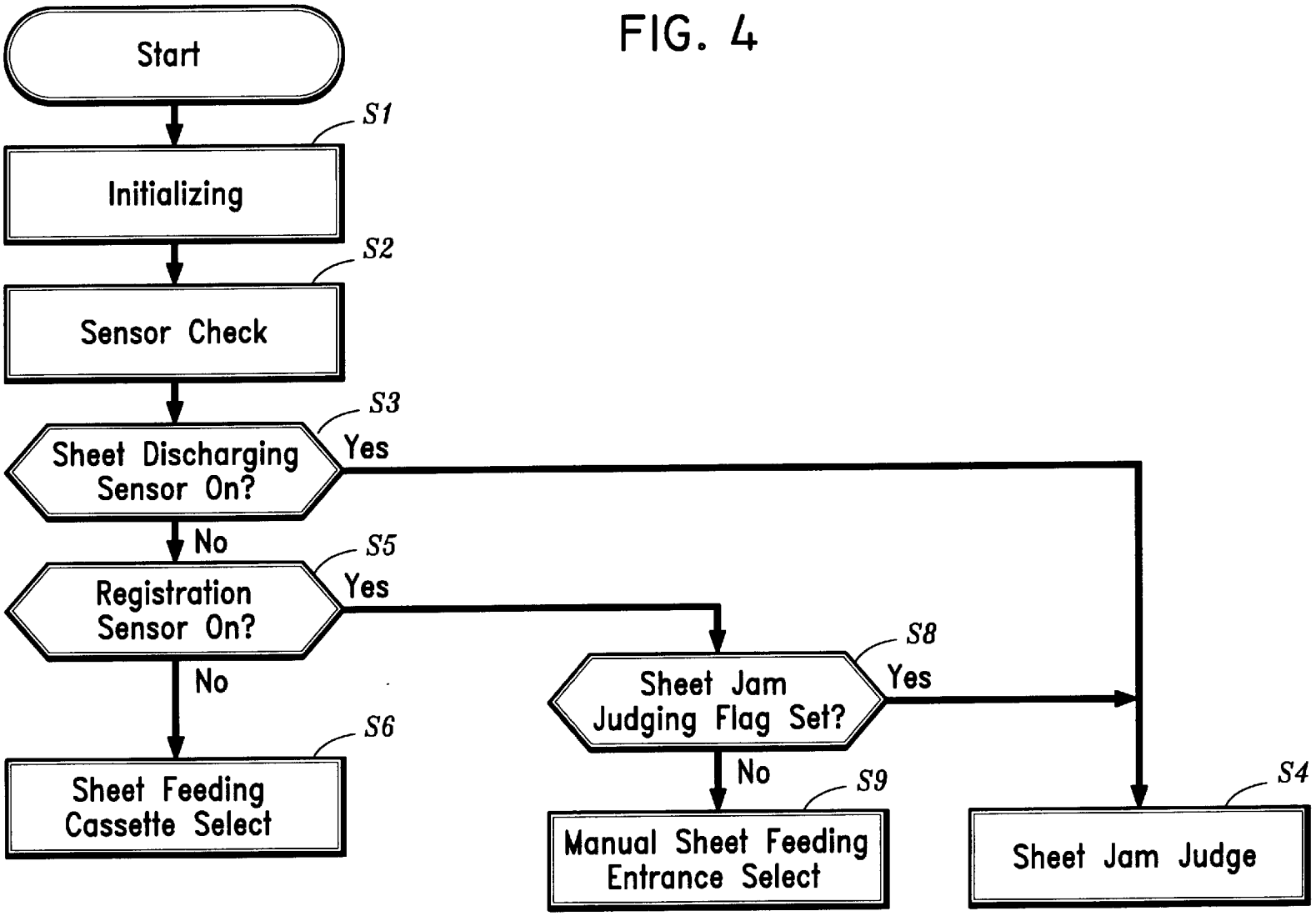
FIG. 4 is a flowchart showing a processing operation according to another embodiment of the present invention.

Although the above-described embodiment is useful in most instances there may be instances where it is not. For example, if the result of detecting the sheet 27 by the registration sensor 11 at a moment the power source is turned on is not used for judging a sheet jam as mentioned above, a sheet feeding operation is executed even though an actual sheet jam may have occurred. Accordingly, if this situation is considered to be a problem, an additional sheet jam judging step may be performed as shown in FIG. 4. (In FIGS. 4–6, steps S1–S6 are similar to steps S1–S6 in FIG. 3. Accordingly, those steps are not described in detail below.) According to this embodiment, a mode selection function may be used for changing the operation mode of the sheet feeding apparatus 1, For example, a mode can be selected to judge a sheet jam in a case when the sheet 27 is detected by the registration sensor 11 at a moment when the main body power source 25 is turned on.

More specifically, a setting flag for setting an operation mode can be provided in the EEPROM 24 of the micro computer 20. The setting flag consisting of a jam judging flag is selected by the user by an operator inputting operation. When step S5 (FIG. 4) is executed, if the registration sensor 11 is turned on, the CPU 21 checks the setting flag in step S8, and according to the state of the setting flag, the CPU either judges a sheet jam (step S4) or selects the manual sheet feeding entrance (step S9). For example, if the flag is set to 1, a sheet jam judgment is made in step S4. If the flag is set to 0, the manual sheet feeding entrance is selected.

If judging the existence of the sheet jam is selected as mentioned above, the sheet feeding apparatus 1 executes an appropriate operation, corresponding to a desired state selected by an operator. For example, in a case of an operator who frequently uses the manual sheet feeding entrance 7, if the operation mode is selected to not judge an occurrence of sheet jam even though the registration sensor detects the sheet 27 at a moment when the power is turned on (in step S8), a manual sheet feeding operation can be immediately started (refer to step S9). On the other hand, in a case of another operator who rarely uses the manual sheet feeding entrance 7, if the operation mode is selected to judge for the occurrence of a sheet jam (YES in step S8) when the sheet 27 is detected by the registration sensor 11 at a moment when the power source is turned on, the occurrence of sheet jam is surely judged (refer to step S4) and can be notified to the user.

Generally, when a sheet jam occurs, a removing operation for removing the jammed sheet is executed while main body power source 25 is turned off. That is the power supply to each of the sections from the main body power source is cut off by opening the sheet conveying path 8 for performing the operation of removing the jammed sheet. The power supply to each of the sections from the main body power source 25 is returned by returning the sheet conveying path 8 into its initial position after finishing the jammed sheet removing operation. In such a case, there is no problem if the sheet removing operation has been performed perfectly (i.e., all sheets have been removed). However on some occasions, the operation of removing the jammed sheets is not performed perfectly and a jammed sheet 27 may remain in the sheet conveying path 8. In other words, when the main body power source 25 is turned off for a sheet removing operation upon detecting a sheet jam by the registration sensor 11, and if the sheet 27 is detected by the registration sensor 11 when the power source is again turned on after the removing operation, there is a high possibility that the sheet jam has not been performed perfectly.

Figure 5:
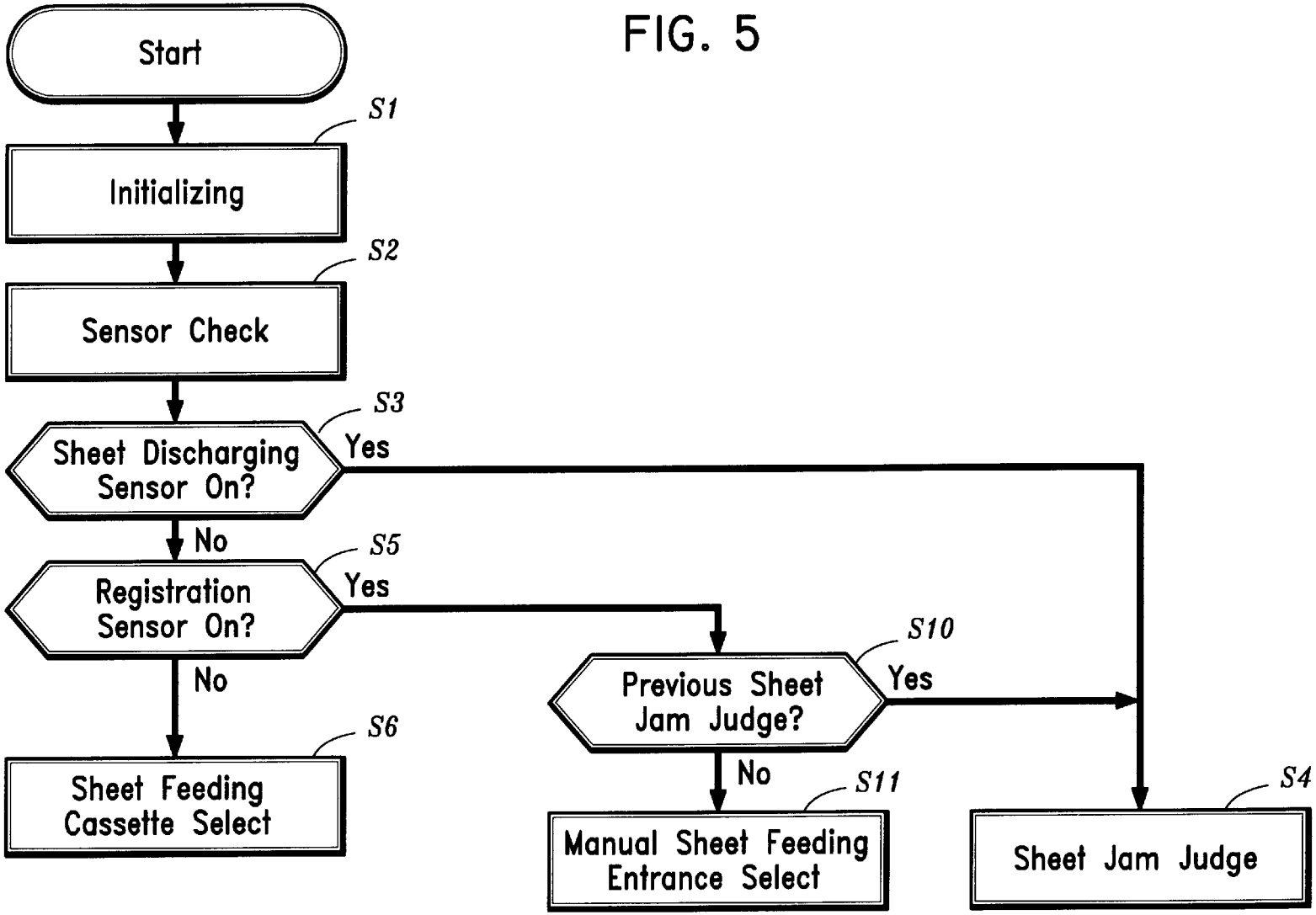
FIG. 5 is a flowchart showing a processing operation according to still another embodiment of the present invention.
Figure 6:
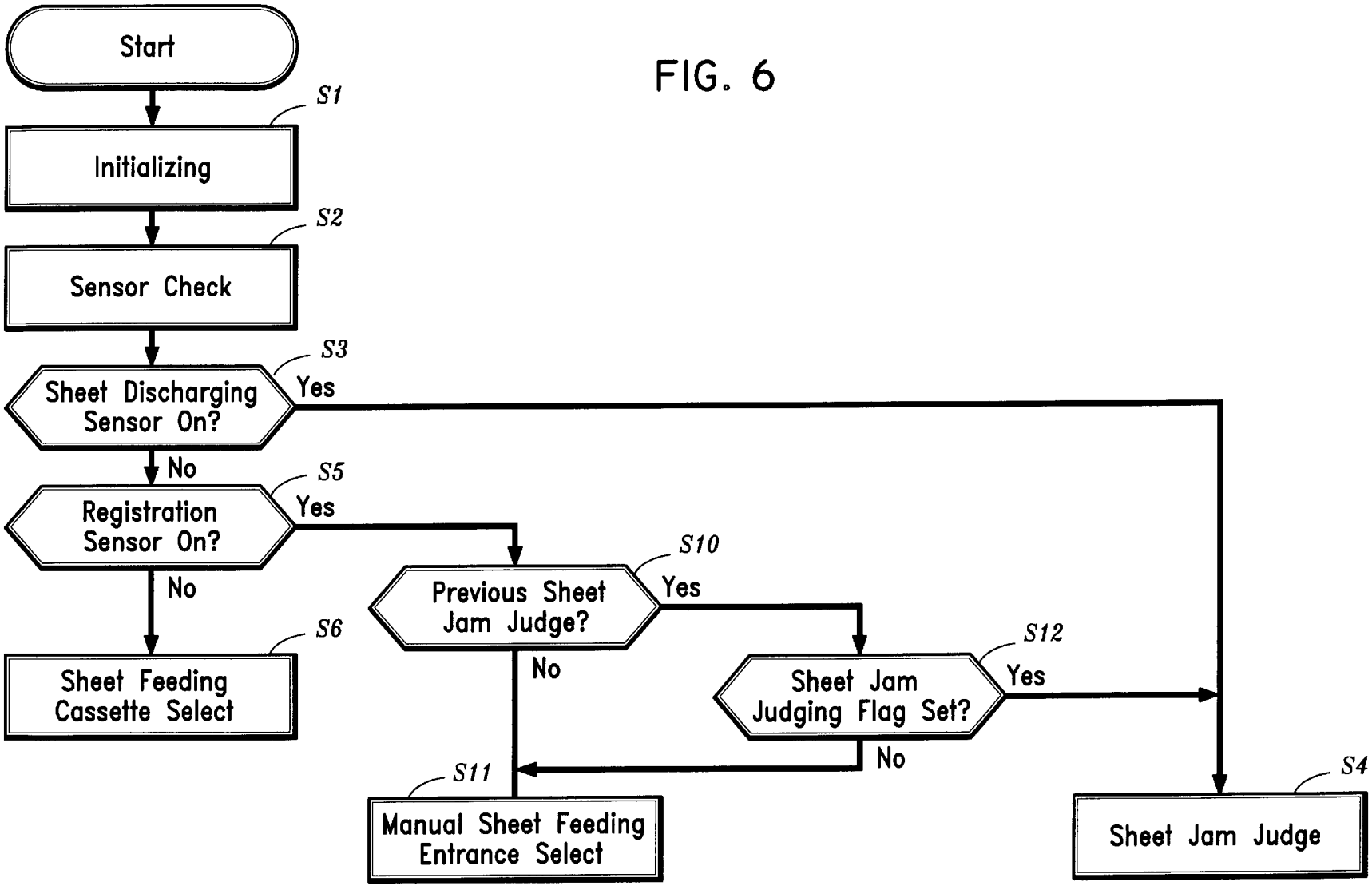
FIG. 6 is a flowchart showing a processing operation according to yet another embodiment of the present invention.

If this situation is considered to be a problem, the EEPROM (in which the contents of the memory is maintained even though the main body power source 25 is cut off) is preferably used to store data indicating a sheet jam. In this method, information indicating whether a sheet jam has occurred just prior to power being turned off is stored in EEPROM 24 by the CPU 21 when power is turned off, and is used to control a judgment for detecting for a sheet jam at a moment when the power source is turned back on. That is, as shown in FIG. 5, when the registration sensor 11 detects the sheet 27 at a moment when the main body power source 25 is turned on, (YES in step S5), the contents of a predetermined location in the memory of the EEPROM 24 are read out by the CPU 21 (step S10). If the occurrence of a sheet jam at a moment when the power source was turned off was stored (YES in step S10), it is determined that a sheet jam had occurred at a moment when the power source was turned off (step S4) and the manual sheet feeding operation can be stopped and the jam notified to the operator. If the occurrence of a sheet jam at a moment when the power source was turned off was not stored (NO in step S10), a sheet jam at a moment when the power source is turned back on is not judged and the manual sheet feeding entrance is selected (step S11).

In this case, when the main body power source 25 is turned off and then on for removing the jammed sheet as mentioned above, the occurrence of a sheet jam is detected by detecting a sheet using the registration sensor 11 at a moment when the power source is turned on, if the removing operation of the jammed sheet has not been performed correctly (YES in step S10). The occurrence of a sheet jam is not judged when the main body power source 25 is turned off and then on when no previous sheet jam has occurred. Accordingly, there occurs no misjudging of the sheet jam, for example, if the main body power source 25 is turned off and then on while the sheet 27 remains in the manual sheet feeding entrance 7 (YES in step 5 and NO in step S10).

According to another embodiment of the present invention, the sheet feeding apparatus 1 is capable of executing an operation corresponding to a desire of the operator by setting the existence or absence of the processing operation as mentioned above to be selective as shown in FIG. 6 (step S12 corresponds to S8 in FIG. 4). In this case, since judging of the occurrence of a sheet jam can be selected to not be executed (NO in step S12) by the user setting the proper flag, the manual sheet feeding operation can be immediately started if a jammed sheet is removed even though the sheet 27 is detected by the registration sensor 11 (YES in step S5), and even though an occurrence of sheet jam at a moment when the power source was turned off was judged and stored (YES in step S10).

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth herein.

This application is based on Japanese Patent Applications No. 08-157793, filed on Jun. 19, 1996, No. 08-182922, filed on Jul. 12, 1996, and No. 09-141251 filed on May 30, 1997; respectively the entire contents of which are herein incorporated by reference.

What is claimed is:

1. A sheet feeding apparatus comprising:

a main body power source for selectively supplying power to sections of the apparatus;

a sheet containing section for containing a plurality of sheets, and a manual sheet feeding entrance for feeding a sheet by manual operation;

a sheet conveying path in which the sheet containing section and the manual sheet feeding entrance are selectively used as a selective start position for feeding a sheet to the conveying path;

a registration mechanism for temporarily stopping the sheet which is fed to the sheet conveying path;

a registration sensor for detecting the sheet which is fed towards the registration mechanism, the registration sensor being disposed at a position wherein a sheet which is inserted into the manual sheet feeding entrance and a sheet conveyed from the sheet containing section are detected;

a sheet feeding controller for operating the registration mechanism after a predetermined time period has passed from a time when the sheet is detected by the registration sensor if the sheet is fed from the sheet containing section, and for operating the registration mechanism after a predetermined time period has passed from a time when the sheet is detected by the registration sensor if the sheet is fed from the manual sheet feeding entrance after being inserted and detected by the registration sensor; and a sheet jam judging unit for judging an occurrence of a sheet jam if the sheet is detected by the registration sensor at an undesirable time other than at a time when the main body power source is turned on.

2. The sheet feeding apparatus according to claim 1, further comprising a mode selector for selecting whether to judge an occurrence of a sheet jam by the sheet jam judging unit when detecting the sheet by the registration sensor at a moment when the power is turned on.

3. The sheet feeding apparatus according to claim 1, wherein the sheet containing section is selected as the start position for sheet feeding if a sheet is not detected by the registration sensor at a moment when the power is turned on, and the manual sheet feeding entrance is selected as a start position for sheet feeding if the sheet is detected by the registration sensor when the power is turned on.

4. The sheet feeding apparatus according to claim 1, further comprising mode selector means for selecting whether to judge an occurrence of a sheet jam by the sheet jam judging means when detecting the sheet by the registration sensor means at a moment when the power is turned on.

5. The sheet feeding apparatus according to claim 1, wherein the sheet containing means is selected as the start position for sheet feeding if a sheet is not detected by the registration sensor means at a moment when the power is turned on, and the manual sheet feeding entrance means is selected as a start position for sheet feeding if the sheet is detected by the registration sensor means when the power is turned on.

6. A sheet feeding apparatus comprising:

a main body power source for selectively supplying power to sections of the apparatus;

a sheet containing section for containing a plurality of sheets, and a manual sheet feeding entrance for feeding a sheet by manual operation;

a sheet conveying path in which the sheet containing section and the manual sheet feeding entrance are selectively used as a selective start position for feeding a sheet to the conveying path;

a registration mechanism for temporarily stopping the sheet which is fed to the sheet conveying path;

a registration sensor for detecting the sheet which is fed towards the registration mechanism, the registration sensor being disposed at a position wherein a sheet which is inserted into the manual sheet feeding entrance and a sheet conveyed from the sheet containing section are detected;

a sheet feeding controller for operating the registration mechanism after a predetermined time period has passed from a time when the sheet is detected by the registration sensor if the sheet is fed from the sheet containing section, and for operating the registration mechanism after a predetermined time period has passed from a time when the sheet is detected by the registration sensor if the sheet is fed from the manual sheet feeding entrance after being inserted and detected by the registration sensor;

a sheet jam judging unit for judging an occurrence of a sheet jam if the sheet is detected by the registration sensor at an undesirable time other than at a time when the main body power source is turned on;

a memory for storing a judging state (result) indicating that a sheet jam occurred prior to power being turned off; and a judgment controller for selecting that the sheet jam judging means not judge an occurrence of a sheet jam if the memory has not stored a judging state indicating that the occurrence of a sheet jam at occurred at a moment when the power was turned off, even though the registration sensor detects a sheet at a moment when the power is turned on.

7. The sheet feeding apparatus according to claim 6, further comprising a mode selector for selecting whether to judge an occurrence of a sheet jam by the sheet jam judging unit when detecting the sheet by the registration sensor at a moment when the main body power source is turned on and the existence of the sheet jam was stored by the memory.

8. The sheet feeding apparatus according to claim 6, wherein the sheet containing section is selected as the start position for sheet feeding if a sheet is not detected by the registration sensor at a moment when the power is turned on, and the manual sheet feeding entrance is selected as a start position for sheet feeding if the sheet is detected by the registration sensor when the power is turned on.

9. A sheet feeding apparatus comprising:

power source means for selectively supplying power to sections of the apparatus;

sheet containing means for containing a plurality of sheets, and manual sheet feeding entrance means for feeding a sheet by manual operation;

sheet conveying path means in which the sheet containing section and the manual sheet feeding entrance are selectively used as a selective start position for feeding a sheet to the conveying path;

registration means for temporarily stopping the sheet which is fed to the sheet conveying path;

registration sensor means for detecting the sheet which is fed towards the registration means, the registration sensor being disposed at a position wherein a sheet which is inserted into the manual sheet feeding entrance and a sheet conveyed from the sheet containing section are detected;

sheet feeding controller means for operating the registration means after a predetermined time period has passed from a time when the sheet is detected by the registration sensor if the sheet is fed from the sheet containing section, and for operating the registration means after a predetermined time period has passed from a time when the sheet is detected by the registration sensor if the sheet is fed from the manual sheet feeding entrance after being inserted and detected by the registration sensor; and sheet jam judging means for judging an occurrence of a sheet jam if the sheet is detected by the registration sensor at an undesirable time other than at a time when the main body power source is turned on.

10. A sheet feeding apparatus comprising:

power source means for selectively supplying power of sections of the apparatus;

sheet containing means for containing a plurality of sheets, and a manual sheet feeding entrance means for feeding a sheet by manual operation;

sheet conveying path means in which the sheet containing means and the manual sheet feeding entrance means are selectively used as a selective start position for feeding a sheet to the conveying path means;

registration means for temporarily stopping the sheet which is fed to the sheet conveying path;

registration sensor means for detecting the sheet which is fed towards the registration means, the registration sensor means being disposed at a position wherein a sheet which is inserted into the manual sheet feeding entrance means and a sheet conveyed from the sheet containing means are detected;

sheet feeding controller means for operating the registration means after a predetermined time period has passed from a time when the sheet is detected by the registration sensor means if the sheet is fed from the sheet containing means, and for operating the registration means after a predetermined time period has passed from a time when the sheet is detected by the registration sensor means if the sheet is fed from the manual sheet feeding entrance means after being inserted and detected by the registration sensor;

sheet jam judging means for judging an occurrence of a sheet jam if the sheet is detected by the registration sensor means at an undesirable time other than at a time when the main body power source means is turned on;

memory means for storing a judging state (result) indicating that a sheet jam occurred prior power being turned off; and judgment controller means for selecting that the sheet jam judging means not judge an occurrence of a sheet jam if the memory means has not stored a judging state indicating that the occurrence of a sheet jam occurred at a moment when the power was turned off, even though the registration sensor means detects a sheet at a moment when the power is turned on.

11. The sheet feeding apparatus according to claim 10, further comprising a mode selector means for selecting whether to judge an occurrence of a sheet jam by the sheet jam judging means when detecting the sheet by the registration sensor means at a moment when the main body power source means is turned on and the existence of the sheet jam was stored by the memory means.

12. The sheet feeding apparatus according to claim 10, wherein the sheet containing means is selected as the start position for sheet feeding if a sheet is not detected by the registration sensor means at a moment when the power is turned on, and the manual sheet feeding entrance means is selected as a start position for sheet feeding if the sheet is detected by the registration sensor means when the power is turned on.

13. A method for operating a sheet feeding apparatus comprising the steps of:

selectively supplying power to sections of the apparatus;

selectively feeding a sheet to a conveying path from a sheet containing section and a manual sheet feeding entrance which are selectively used as a start position;

temporarily stopping the fed sheet by use of a registration mechanism;

detecting the sheet, as it is fed towards the registration mechanism;

operating the registration mechanism after a predetermined time period has passed from a time when the sheet is detected by the registration sensor if the sheet is fed from the sheet containing section;

operating the registration mechanism after a predetermined time period has passed from a time when the sheet is detected by the registration sensor if the sheet is fed from the manual sheet feeding entrance after being inserted and detected by the registration sensor; and judging an occurrence of a sheet jam if the sheet is detected by the registration sensor at an undesirable time other than at a time when power is turned on to the apparatus.

14. The method recited in claim 13, further comprising the step of selecting whether to judge an occurrence of a sheet jam when detecting the sheet at a moment when the power is turned on.

15. The method recited in claim 13, further comprising the step of:

selecting the sheet containing section as the start position for sheet feeding if a sheet is not detected by the registration sensor at a moment when the power is turned on, and the manual sheet feeding entrance as a start position for sheet feeding if the sheet is detected by the registration sensor when the power is turned on.

16. A method for operating a sheet feeding apparatus comprising the steps of:

selectively supplying power to sections of the apparatus;

selectively feeding a sheet to a conveying path from a sheet containing section and a manual sheet feeding entrance which are selectively used as a start position;

temporarily stopping the fed sheet by a registration mechanism;

detecting the sheet as it is fed towards the registration mechanism;

operating the registration mechanism after a predetermined time period has passed from a time when the sheet is detected by the registration sensor if the sheet is fed from the sheet containing section;

operating the registration mechanism after a predetermined time period has passed from a time when the sheet is detected by the registration sensor if the sheet is fed from the manual sheet feeding entrance after being inserted and detected by the registration sensor;

judging an occurrence of a sheet jam if the sheet is detected by the registration sensor at an undesirable time other than at a time when power is turned on to the apparatus;

storing in memory a result of judging indicating that a sheet jam occurred prior to power being turned off; and selecting that the sheet jam not be judged if the result of judging stored in memory does not indicate that a jam occurred at a moment when power was turned off, even though a sheet is detected when power is again turned on.

17. The method recited in claim 16, further comprising the step of;

selecting whether to judge an occurrence of a sheet jam when detecting the sheet at a moment when the main body power source is turned on and the existence of the sheet jam was stored by the memory.

18. The method recited in claim 16, further comprising the steps of:

selecting the sheet containing section as the start position for sheet feeding if a sheet is not detected by the registration sensor at a moment when the power is turned on; and selecting the manual sheet feeding entrance as a start position for sheet feeding if the sheet is detected by the registration sensor when the power is turned on.

* * * * *